US009261269B2

(12) United States Patent
Jurik et al.

(10) Patent No.: US 9,261,269 B2
(45) Date of Patent: Feb. 16, 2016

(54) HEAT PROTECTION AND HOMOGENIZING SYSTEM FOR A LUMINAIRE UTILIZING A LAMP WITH AN INTENSE HOTSPOT

(71) Applicants: Pavel Jurik, Prostredni Becva (CZ); Josef Valchar, Prostredni Becva (CZ)

(72) Inventors: Pavel Jurik, Prostredni Becva (CZ); Josef Valchar, Prostredni Becva (CZ)

(73) Assignee: ROBE Lighting s.r.o., Postredni Becva (CZ)

( * ) Notice: Subject to any disclaimer, the term of this patent is extended or adjusted under 35 U.S.C. 154(b) by 0 days.

(21) Appl. No.: 14/042,758

(22) Filed: Oct. 1, 2013

(65) Prior Publication Data

US 2015/0092422 A1 Apr. 2, 2015

(51) Int. Cl.

| | |
|---|---|
| ***F21V 14/08*** | (2006.01) |
| ***F21V 29/10*** | (2015.01) |
| ***F21S 10/00*** | (2006.01) |
| ***F21V 9/04*** | (2006.01) |
| ***F21V 13/14*** | (2006.01) |
| *F21W 131/406* | (2006.01) |

(52) U.S. Cl.

CPC ..... *F21V 29/10* (2015.01); *F21S 10/00* (2013.01); *F21V 9/04* (2013.01); *F21V 13/14* (2013.01); *F21V 14/08* (2013.01); *F21S 10/007* (2013.01); *F21W 2131/406* (2013.01)

(58) Field of Classification Search

CPC ..... F21S 10/007; F21S 10/026; F21V 5/007–5/008; F21V 3/04–3/0445; F21V 13/00–13/14; F21V 14/06; F21V 14/04; F21V 14/08; F21K 9/58; F21W 2131/407; F21W 2131/105

See application file for complete search history.

(56) References Cited

U.S. PATENT DOCUMENTS

| | | | | |
|---|---|---|---|---|
| 4,151,584 | A * | 4/1979 | Labrum | 362/302 |
| 6,241,366 | B1 * | 6/2001 | Roman et al. | 362/293 |
| 2002/0075685 | A1 * | 6/2002 | Rasmussen et al. | 362/282 |
| 2003/0151836 | A1 * | 8/2003 | Davis | 359/892 |
| 2007/0211468 | A1 * | 9/2007 | Allegri | 362/268 |

* cited by examiner

*Primary Examiner* — Julie Bannan

(57) ABSTRACT

An automated luminaire which allows for the selection of a diffuser or a hot mirror which is mounted to engage the light beam at an angle non perpendicular to the central axis of the light beam and nonparallel or not in the same plane as the diffuser. The selector is articulated in a manner to automatically engage a selector based on what other light modulators are selected to engage the light beam and to automatically oscillate or scan when there is a likelihood of damage to the hot mirror or diffuser based on how long it is engaged and/or light intensity and/or other modulators selected and or temperature sensor data in the luminaire.

16 Claims, 8 Drawing Sheets

HEAT PROTECTION AND HOMOGENIZING SYSTEM FOR A LUMINAIRE UTILIZING A LAMP WITH AN INTENSE HOTSPOT

TECHNICAL FIELD OF THE INVENTION

The present invention generally relates to an automated luminaire, specifically to a heat protection and homogenization system in an automated luminaire.

BACKGROUND OF THE INVENTION

Luminaires with automated and remotely controllable functionality are well known in the entertainment and architectural lighting markets. Such products are commonly used in theatres, television studios, concerts, theme parks, night clubs and other venues. A typical product will commonly provide control over the pan and tilt functions of the luminaire allowing the operator to control the direction the luminaire is pointing and thus the position of the light beam on the stage or in the studio. Typically this position control is done via control of the luminaire's position in two orthogonal rotational axes usually referred to as pan and tilt. Many products provide control over other parameters such as the intensity, color, focus, beam size, beam shape and beam pattern. The beam pattern is often provided by a stencil or slide called a gobo which may be a steel, aluminum or etched glass pattern. The products manufactured by Robe Show Lighting such as the Robin MMX Spot are typical of the art.

The optical systems of such automated luminaires may be designed such that a very narrow output beam is produced so that the units may be used with long throws or for almost parallel light laser like effects. These optics are often called 'Beam' optics. To form this narrow beam with the large light sources in the prior art the output lens either needed to be very large with a large separation between the lens and the gobos or of a short focal length and much closer to the gobos. It is problematic to use a large separation with a large lens as such an arrangement makes the luminaire large and unwieldy and makes automation of the pan and tilt movement difficult. Thus the normal solution is a closer and smaller lens with a short focal length. Alternatively the thick heavy front lens may be replaced with a Fresnel lens where the same focal length is achieved with a much lighter molded glass lens using multiple circumferential facets. Fresnel lenses are well known in the art and can provide a good match to the focal length of an equivalent plano-convex lens, however the image projected by such a lens is typically soft edged and fuzzy and not a sharp image as may be desired when projecting gobos or patterns.

FIG. 1 illustrates a multiparameter automated luminaire system 10. These systems commonly include a plurality of multiparameter automated luminaires 12 which typically each contain on-board a light source (not shown), light modulation devices, electric motors coupled to mechanical drives systems and control electronics (not shown). In addition to being connected to mains power either directly or through a power distribution system (not shown), each luminaire is connected is series or in parallel to data link 14 to one or more control desks 15. The luminaire system 10 is typically controlled by an operator through the control desk 15. Control of the automated luminaire 12 is effectuated by electromechanical devices within the luminaire 12 and electronic circuitry 13 including firmware and software within the control desk 15 and/or the luminaire 12. In many of the figures herein, important parts like electromechanical components such as motors and electronic circuitry including software and firmware and some hardware are not shown in order to simplify the drawings so as to teach how to practice the inventions taught herein. Persons of skill in the art will recognize the need for these parts and should be able to readily fill in these parts.

FIG. 2 illustrates a prior art automated luminaire 12. A lamp 21 contains a light source 22 which emits light. The light is reflected and controlled by reflector 20 through a hot mirror 23, aperture or imaging gate 24, and optical devices 25, 27 which may include dichroic color filters, effects glass and other optical devices well known in the art. Optical components 27 are the imaging components and may include gobos, rotating gobos, iris and framing shutters. The final output beam may be transmitted through focusing lens 28 and output lens 29. Lens 29 may be a short focal length glass lens or equivalent Fresnel lens as described herein. Either optical components 27, lens 28, or lens 31 may be moved backwards and forwards along the optical axis to provide focus and/or beam angle adjustment for the imaging components. Hot mirror 23 is required to protect the optical systems 25 and 27 from high infra-red energy in the light beam and typically comprises a glass plate with a thin film dichroic coating designed to reflect long wavelength infra-red light radiation and only allow the shorter wavelength, visible, light to pass through and into the optical system.

More recently lamps 21 with extremely small light sources 22 have been developed. These often use a very short arc gap, of the order of 1 mm, between two electrodes as the light producing means. These lamps are ideal for producing a very narrow beam as their source etendue is low, and the size of the lenses and optical systems to collimate the light from such a small source can be substantially reduced. However, the short arc and small light source coupled with the short focal length, and thus large light beam angles, of the reflector also tend to produce a light beam with large amounts of energy concentrated in the central region, known as a hotspot. This intense central energy region is not ideal for producing a large even wash of light, and can easily damage or destroy elements of optical systems 25 and 27, in particular glass gobos and projection patterns will be damaged by the intense central hotspot. The light energy damages the surface coatings and materials of the gobos. A diffusing or homogenizing filter can be added to ameliorate the hotspot, producing improved wash light performance and protecting the optical elements, however this has the unwanted side effect of reducing the luminaires ability to produce a narrow tight beam.

There is an increased need for an improved heat projection and homogenizing system for an automated luminaire utilizing a light source with an intense hotspot such that the luminaire is capable of producing a narrow light beam in a first mode, and of producing a wide wash beam or projecting gobos without damaging them in a second mode.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

Preferred embodiments of the present invention are illustrated in the FIGURES, like numerals being used to refer to like and corresponding parts of the various drawings.

The present invention generally relates to an automated luminaire, specifically to the design and operation of a heat protection and homogenization system for use within the automated luminaire utilizing a light source with an intense hotspot such that the luminaire is capable of producing a narrow light beam in a first mode, and of producing a wide, even, wash beam or projecting gobos without damaging them or compromising the narrow beam performance in a second mode.

Figure 1:
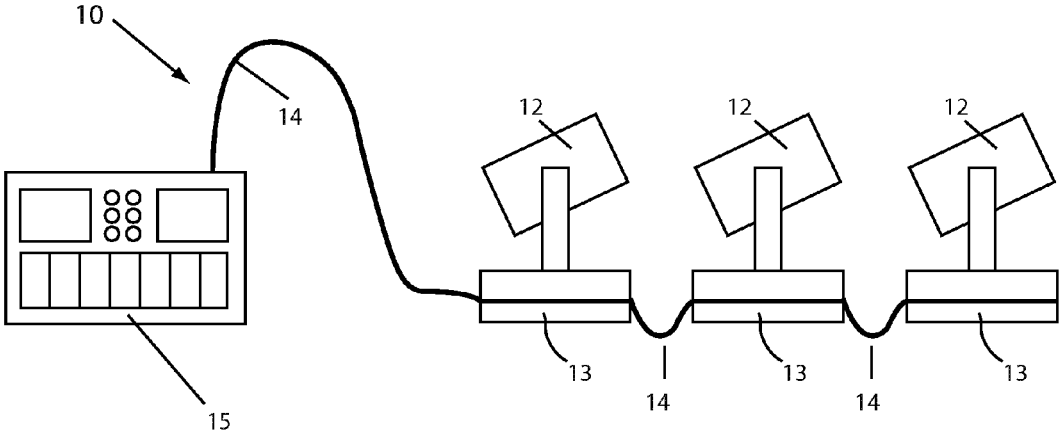
FIG. 1 illustrates a typical automated lighting system.
Figure 2:
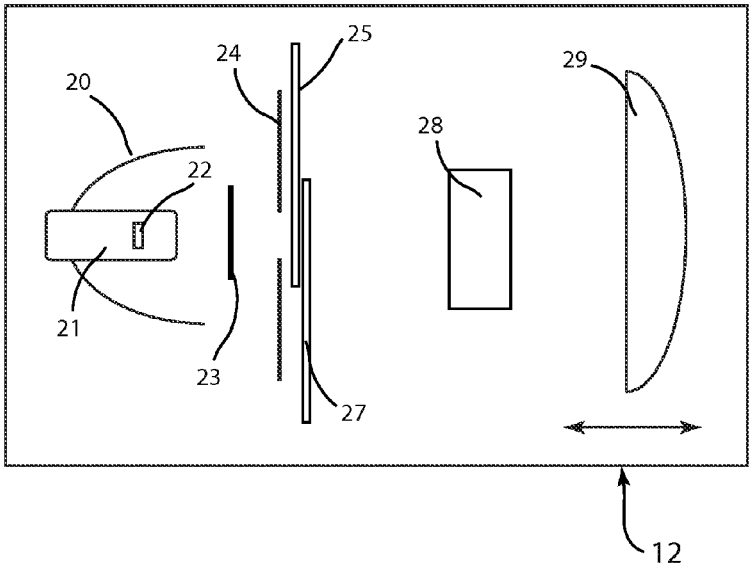
FIG 2 Prior art
FIG. 2 illustrates a prior art automated luminaire.
Figure 3:
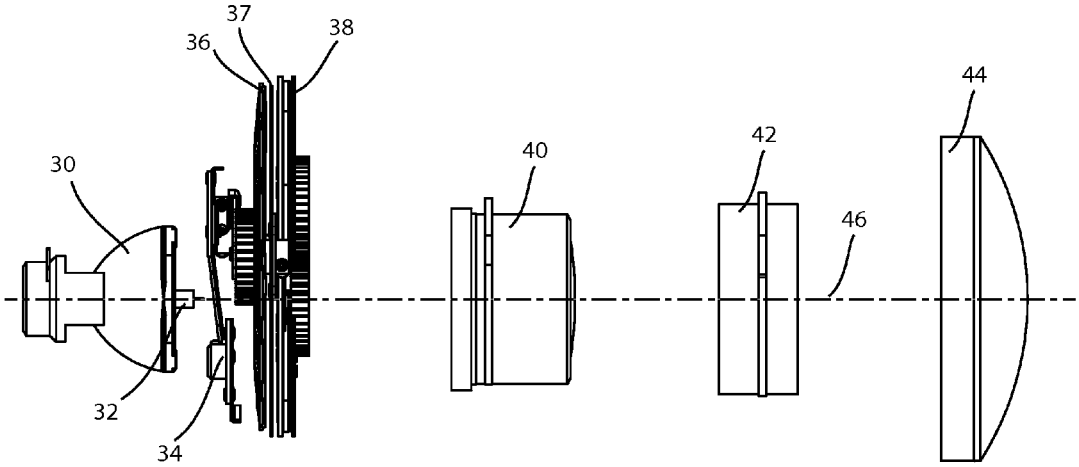
FIG. 3 illustrates an embodiment of an automated luminaire with the combined heat protection homogenization light beam modulation system.

FIG. 3 illustrates an embodiment of the invention. The automated luminaire contains a light source 32 within reflector 30. Light source 32 may be a short arc discharge lamp with arc length of approximately 1 mm, and reflector 30 may be an ellipsoidal glass reflector. The combination of a short arc light source and an ellipsoidal reflector is well known in the art and produces a light beam towards the second focus of the ellipsoidal reflector. Such a beam typically has a very high energy beam center, or hotspot, which can be damaging to downstream optics and other light modulating devices. The beam also produces a poor wide beam pattern when trying to use the luminaire as a wash light. In the automated luminaire embodiment shown, the light beam passes through the heat protection and homogenization system 34 before passing through optical systems such as, for example, color system 36, static gobo system 37, and rotating gobo system 38. The light beam then continues through lenses 40, 42, and 44 which may each individually or cooperatively be capable of movement along optical axis 46 so as to alter the focus and beam angle or zoom of the light beam.

Optical elements such as static gobo system 37 and rotating gobo system 38 may contain gobos or patterns that can be damaged by an intense hotspot. Such gobos may have a glass substrate with layers of aluminum, thin film coatings or other means for creating an image layer on the glass. The energy gradient from a light beam with an intense hotspot may damage these coatings or crack or melt the glass. Similarly, devices such as irises or framing shutters may be damaged by the hotspot. The heat protection and homogenization system 34 of the invention protects these hotspot sensitive devices or gobos by automatically introducing a diffuser or homogenizing filter into the light path whenever a gobo or other heat sensitive device is inserted into the light beam. This diffuser or homogenizing filter is similarly automatically removed from the light beam when all hotspot or heat sensitive devices are removed from the light beam, and may replace it with a simple hot mirror. The user may also manually position the heat protection and homogenization system 34 such that the diffuser or homogenizing filter is across the light beam when it is desired to produce a wide, smooth light beam for use as a wash light. In this mode lenses 40, 42, and 44 may be adjusted so as to provide a wide beam angle or zoom and the resultant beam will be smooth and flat with no intense bright central hotspot. Alternatively, the user may manually position the heat protection and homogenization system 34 such that the hot mirror is across the light beam when it is desired to produce a very tight, narrow beam of light. In such circumstances the central hotspot is useful to the optics and it is desirable to remove all homogenization or diffusion such that the light beam is as narrow and sharp as possible.

Figure 4:
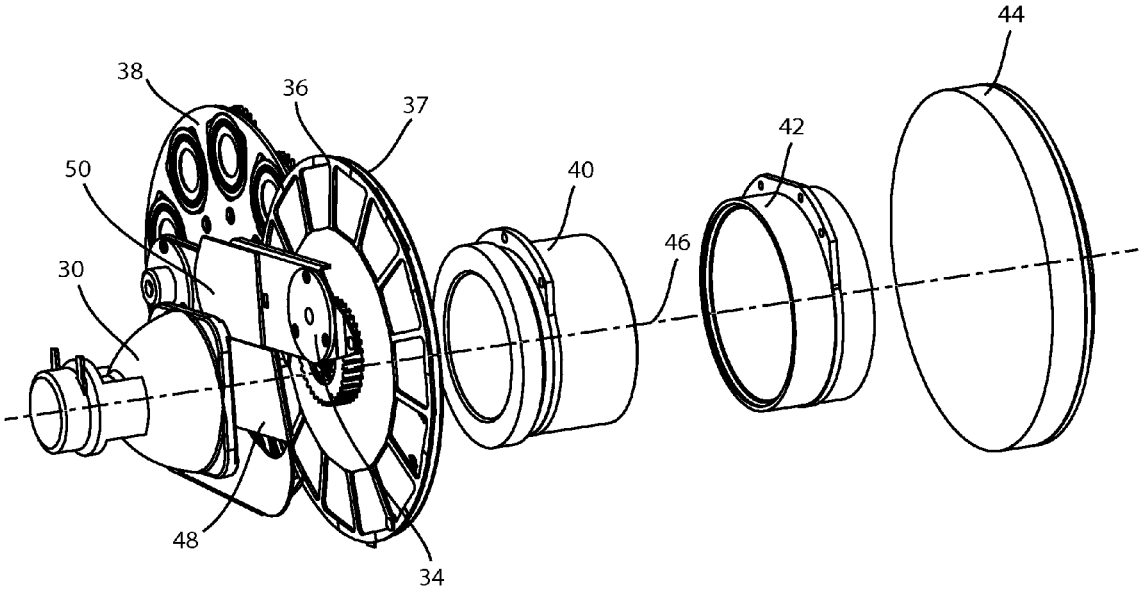
FIG. 4 illustrates an isometric view of an embodiment of the automated luminaire of FIG. 3 with the modulation system in one position.

FIG. 4 illustrates a perspective view of an embodiment of the invention which more clearly shows the heat protection and homogenization system 34. The heat protection and homogenization system 34 comprises an arm with two filters or flags, 48 and 50. Filter 48, which is in the optical path in FIG. 4, is a hot mirror, that is a filter, usually made as thin film coatings on glass, that reflects back infra-red and other long wavelength energy, while allowing visible light to pass. Filter 50, shown outside of the optical path in FIG. 4, is a diffuser or homogenizing filter. This may be manufactured as a frosted glass, lenticular glass, bead lens or filter, particulate frost filter, or other kind of homogenizing filter as well known in the art. Diffuser or homogenizing filter 50 will spread out and dissipate the central hotspot in the light beam, providing a flatter, more diffuse beam that will not damage optical devices 36, or gobos on gobo wheel 37 and gobo wheel 38 and will produce a smoother wash light beam.

Figure 5:
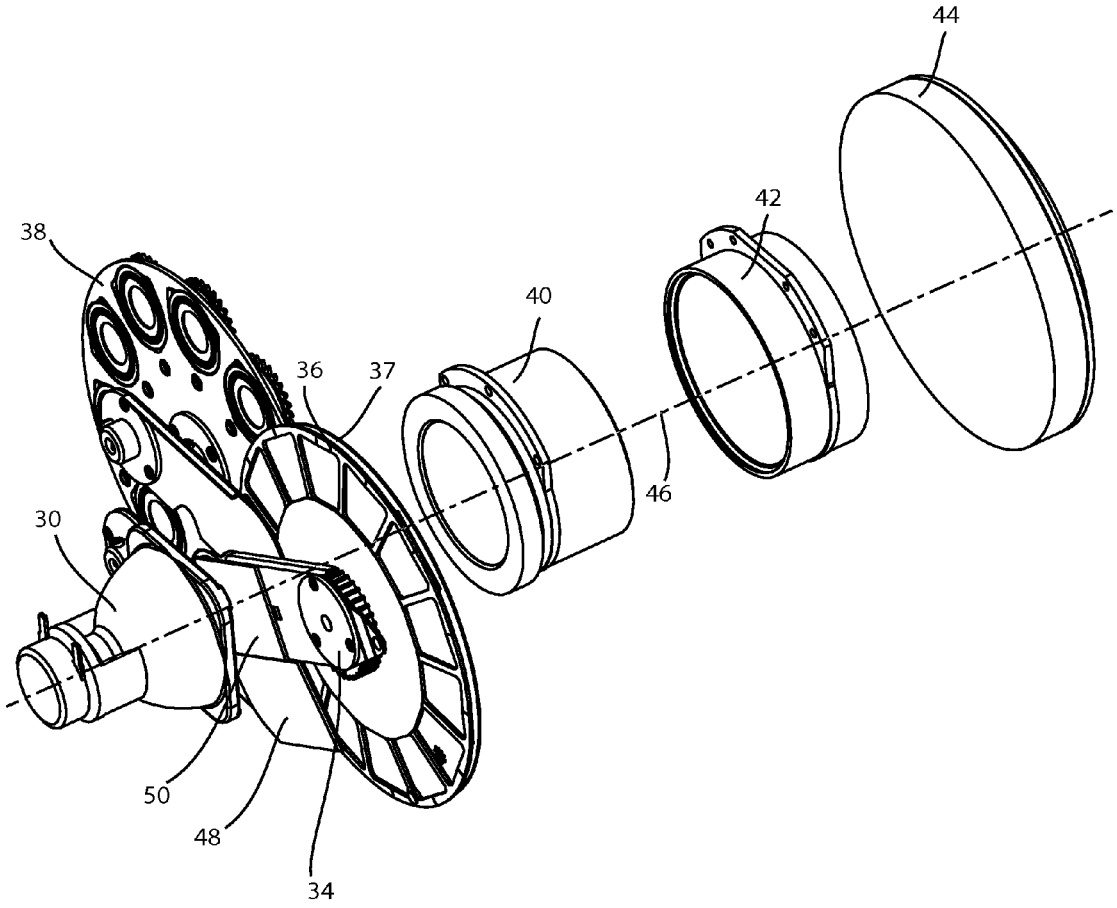
FIG. 5 illustrates an isometric view of an embodiment of the automated luminaire of FIG. 3 with the modulation system in another position.

FIG. 5 illustrates a further perspective view of an embodiment of the invention which more clearly shows the heat protection and homogenization system 34. In this figure the heat protection and homogenization system 34 has been rotated such that the diffuser or homogenizing filter, 50, is in the optical path and the hot mirror filter, 48, is removed from the optical path. The heat protection and homogenization system 34 may be rapidly rotated from a first position where the hot mirror 48 is in the optical path to a second position where the diffuser or homogenizing filter 50 is in the optical path. The means for this movement may be as shown in the figures using a pivoted arm driven through gears and a stepper motor (not shown in figures), or may be through other mechanical means such as linear actuators, lead screw, rack and pinion drive, direct drive motors, servo motors, solenoids or other devices well known in the art without departing from the spirit of the invention. Filters 48 and 50 may also be mounted on two separate arms which would allow either or both to be inserted across the light beam as desired.

Figure 6:
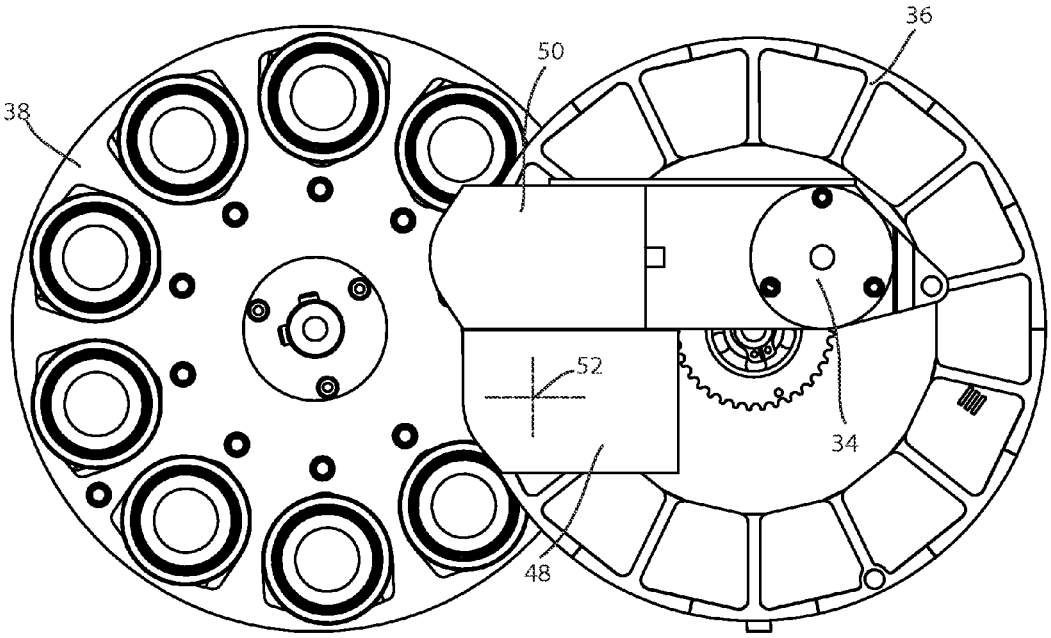
FIG. 6 illustrates a view of the combined heat protection and homogenizing system embodiment of FIG. 3 in the position of FIG. 4 down the central axis of the light beam.
Figure 7:
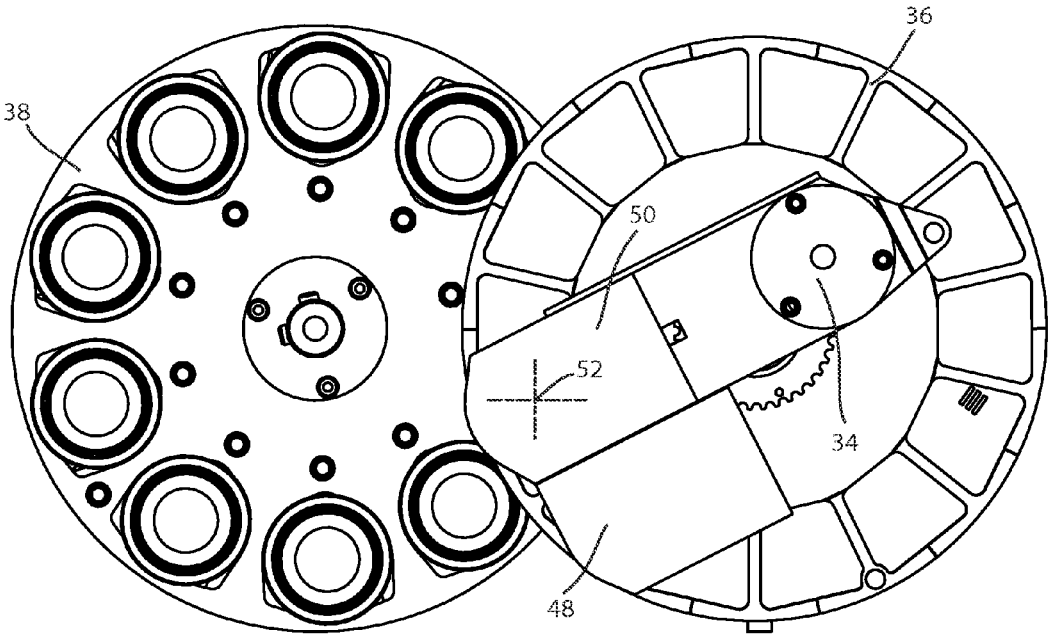
FIG. 7 illustrates a view of the combined heat protection and homogenizing system embodiment of FIG. 3 in the position of FIG. 5 down the central axis of the light beam.

FIGS. 6 and 7 further illustrate the two positions of the heat protection and homogenization system 34. In FIG. 6 the hot mirror 48 is in the optical path as shown by the optical axis marker 52. While in FIG. 7 heat protection and homogenization system 34 has been rotated such that diffuser or homogenization filter 50 is in the optical path as shown by the optical axis marker 52.

Figure 8:
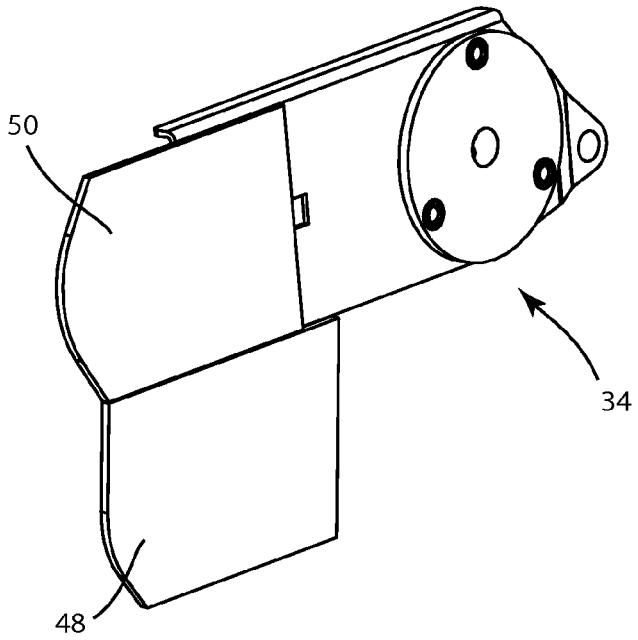
FIG. 8 illustrates a isometric view of portions of the combined heat protection and homogenizing system of the embodiment illustrated in FIG. 7.
Figure 9:
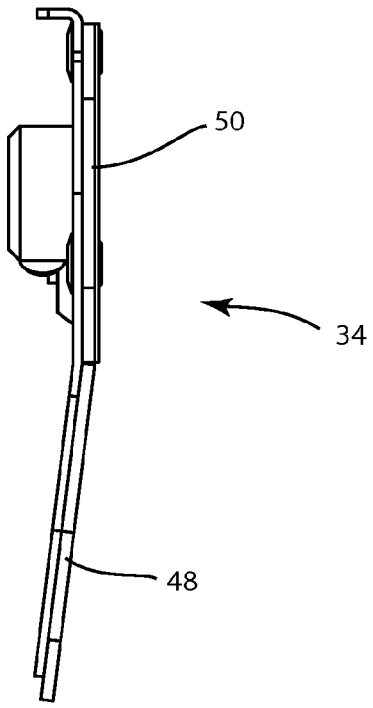
FIG. 9 illustrates a side view of portions of the combined heat protection and homogenizing system of an embodiment of the invention.

FIGS. 8 and 9 show further detail of one embodiment of the heat protection and homogenization system 34 with its hot mirror 48 and diffuser or homogenizing filter 50. In some embodiments the hot mirror 48 may be mounted at an angle to the optical axis as shown clearly in FIG. 9. Angling hot mirror 48 slightly as shown prevents the infra-red and other long wavelength energy reflected by hot mirror 48 from being sent back directly into the lamp, potentially overheating it. Instead that energy is deflected to one side away from the lamp. Diffuser or homogenizing filter 50 may be constructed of a single substrate as shown in FIGS. 8 and 9, or may comprise two or more layers. In one embodiment the diffuser or homogenizing filter 50 may be a single substrate with a hot mirror coating on one of its surfaces so as to also act as a hot mirror as well as a diffuser. In another embodiment the diffuser or homogenizing filter 50 may comprise two or more substrates, of which at least a first substrate is a diffuser or homogenizer and at least a second substrate is a hot mirror.

In a further embodiment of the invention the heat protection and homogenization system 34 may continually oscillate between two positions on either or both of the hot mirror 48 or the diffuser or homogenization filter 50 during operation. In some circumstances the hot mirror 48 or diffuser or homogenizing filter 50 itself could be sensitive to the damaging effects of the hotspot it is trying to mitigate. To help protect the hot mirror or diffuser or homogenizing filter it may be continually moved back and forth across the light beam thus exposing different areas of the filter to the hotspot and spreading the heat energy over a larger area of the filter.

Figure 10:
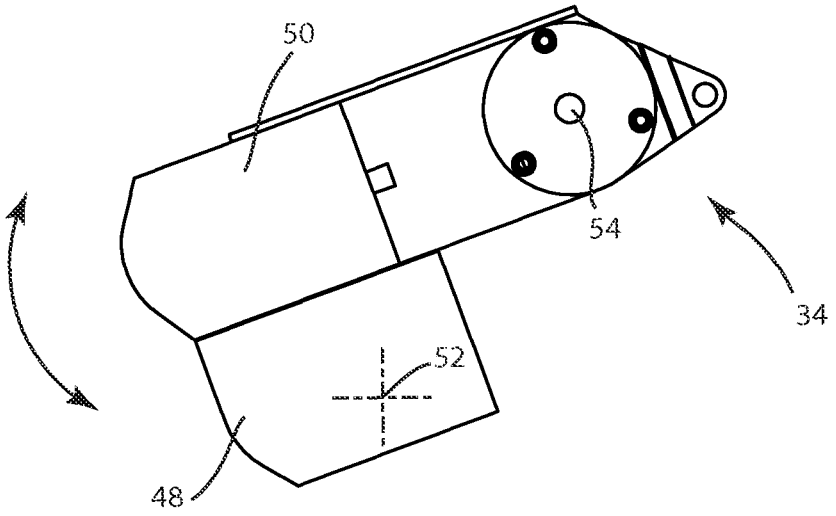
FIG. 10 illustrates a view down the central axis of the light beam of portions of the combined heat protection and homogenizing system on one extreme of the range of motion for the position illustrated in FIG. 6.
Figure 11:
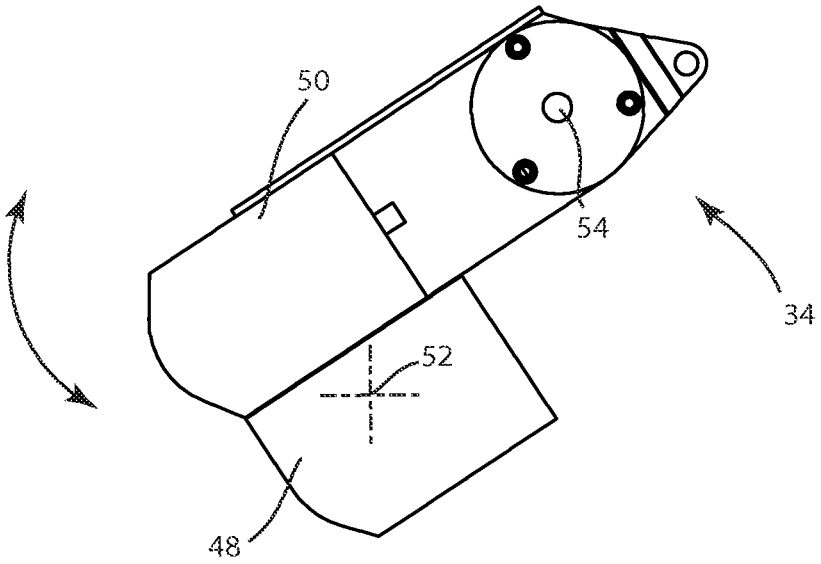
FIG. 11 illustrates an view down the central axis of the light beam of the portions of the combined heat protection and homogenizing system illustrated in FIG. 10 at the opposite extreme range of motion for the position illustrated in FIG. 6.

FIGS. 10 and 11 illustrate the two end positions of the heat protection and homogenization system 34 when it is oscillating in this manner to protect the c. In FIG. 10 a first portion of hot mirror 48 is in the optical path as shown by the optical axis marker 52. While in FIG. 11 heat protection and homogenization system 34 has been rotated such that a second portion of hot mirror 48 is in the optical path as shown by the optical axis marker 52. In one such embodiment this oscillation may be modulated at rates of approximately 0.5 Hz in a sinusoidal pattern. However other movement rates/oscillation frequencies and/or other wave patterns could be used while still retaining the innovative features of the invention.

The diffuser or homogenization filter 50 may be similarly protected by oscillating the protection and homogenization system 34. In other embodiments, color wheels could be modulated in a similar manner. However in such an embodiment, the colors on the color wheel would have to be large enough to allow for a sufficient range of oscillation motion. The range of motion necessary, in the case of a color wheel may be different for different colors.

Figure 12:
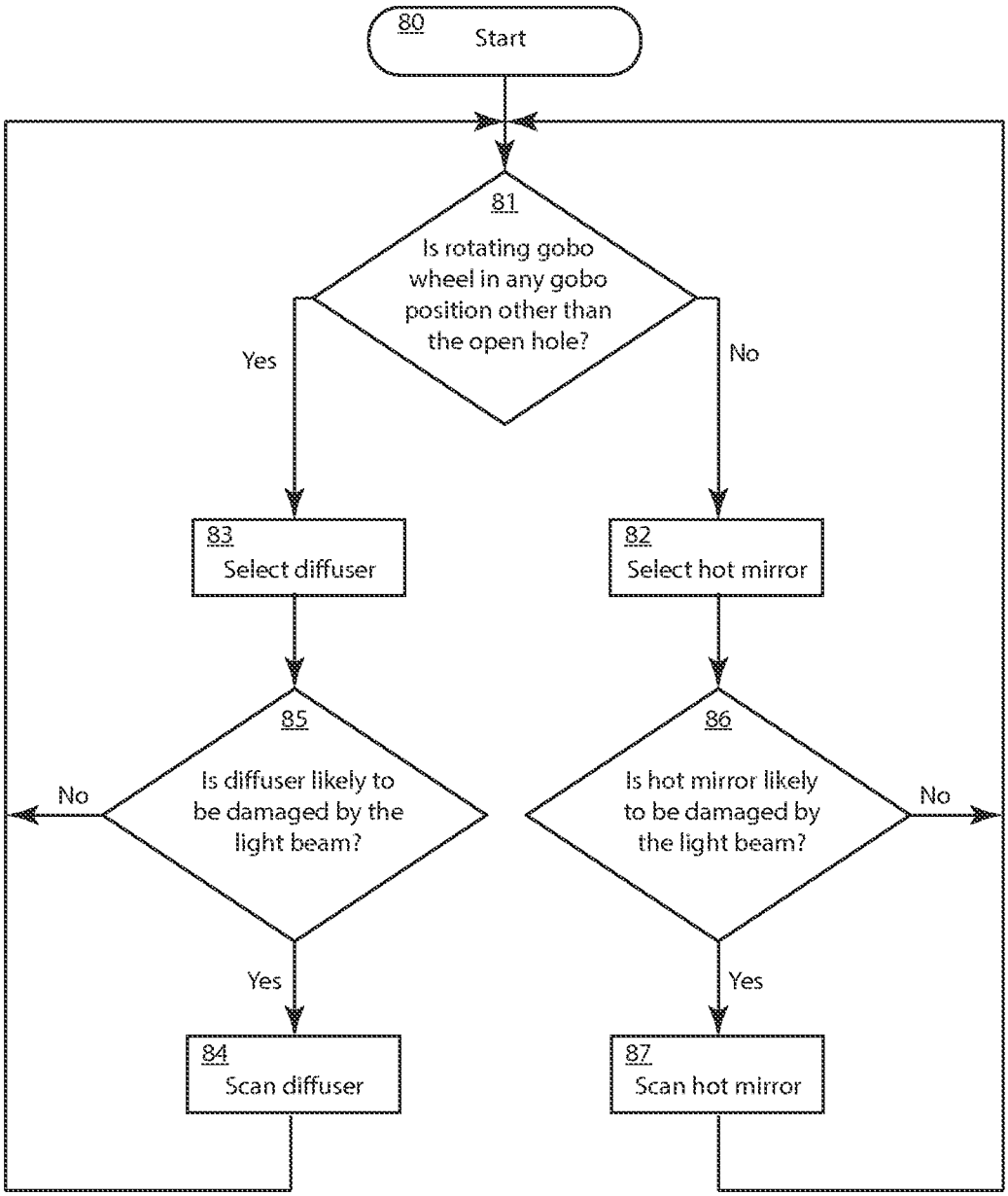
FIG. 12 illustrates a flow chart of the control of the combined heat protection and homogenizing system in an embodiment of the invention.

FIG. 12 shows a flow chart describing the logic followed by the control system within the luminaire that establishes the algorithm for protecting the gobo wheel. When the automated luminaire is on the software monitors to see if the gobo wheel is in the open position or in some other gobo position 81. (In alternative embodiments, the logic can dictate that whenever the gobo wheel is moved to the open position the hot mirror of the combined heat protection homogenization is selected to engage the light beam.) If the open position is engaged then the hot mirror is selected to engage the light beam. 82 The system then monitors the operation of the luminaire to determines whether the status of the luminaire may cause risk of damage to the hot mirror. 86 If so, the hot mirror is scanned or oscillated. 87 and the system continues to look for a change in gobo position 81. In determining a risk of damage, the software may consider, how long the hot mirror has been engaged, how long it is expected to be engaged given preprogramed lighting instructions, fixture temperature, ambient temperature and other factors.

If the gobo wheel is in a non-open gobo position, 81 then the diffuser portion of the combined heat protection homogenizer is selected to engage the light beam. 83 (In alternative embodiments, the logic can dictate that whenever the gobo wheel is moved off of the non non-open gobo position, the diffuser portion of the combined heat protection homogenization is selected to engage the light beam.) The system then monitors the operation of the luminaire to determines whether the status of the luminaire may cause risk of damage to the diffuser 85. If so the diffuser is scanned or oscillated. 84 In determining a risk of damage, the software may consider, how long the portion engaged has been engaged, how long it is expected to be engaged given preprogramed lighting instructions, fixture temperature, ambient temperature and other factors.

In this above example it is assumed that the heat sensitive optical devices that could be damaged by the hotspot in an unhomogenized light beam are mounted in the rotating gobo wheel. The algorithm may be simply amended to accommodate any further heat sensitive devices such as the color wheel(s) in a similar manner.

While the disclosure has been described with respect to a limited number of embodiments, those skilled in the art, having benefit of this disclosure, will appreciate that other embodiments may be devised which do not depart from the scope of the disclosure as disclosed herein. The disclosure has been described in detail, it should be understood that various changes, substitutions and alterations can be made hereto without departing from the spirit and scope of the disclosure.

We claim:

1. An automated multiparameter luminaire comprising:
a light source generating a light beam with a central axis;
a plurality of light modulators;
wherein one of the light modulators is a combined hot mirror and light diffuser
which is articulated to engage the light beam and disengage the light beam; and
while the hot mirror engages the light beam, the articulation is oscillated over a range of motion that maintains full engagement of the hot mirror in the beam while varying its position within the light beam.

2. An automated multiparameter luminaire of claim 1 wherein one or more of the other light modulators are heat sensitive devices.

3. An automated multiparameter luminaire of claim 1 wherein the hot mirror engages the light beam an a non-normal (not perpendicular) to the central axis of the light beam whereby the reflected energy is not directed directly back at the light source of the light beam.

4. An automated multiparameter luminaire of claim 1 wherein one or more of the other light modulators is a glass gobo.

5. An automated multiparameter luminaire of claim 1 wherein the engagement of the hot mirror in the light beam is automatic when a heat sensitive modulator is selected.

6. An automated multiparameter luminaire comprising:
a light source generating a light beam with a central axis;
a plurality of light modulators;
wherein one of the light modulators is a diffuser with a hot mirror coating;
which is articulated to engage the light beam and disengage the light beam; and while the diffuser with hot mirror coating engages the light beam, the articulation is oscillated over a range of motion that maintains full engagement of the hot mirror in the beam while varying its position within the light beam.

7. An automated multiparameter luminaire of claim 6 wherein one or more of the other light modulators are heat sensitive devices.

8. An automated multiparameter luminaire of claim 6 wherein one or more of the other light modulators is a glass gobo.

9. An automated multiparameter luminaire of claim 6 wherein the engagement of the diffuser in the light beam is automatic when a heat sensitive modulator is selected.

10. An automated multiparameter luminaire comprising:

a light source generating a light beam with a central axis;

an articulated selector for selecting the engagement with the light beam of either:

a hot mirror, or a light diffuser/homogenizer with a hot mirror coating.

11. An automated multiparameter luminaire of claim 10 wherein one or more of the other light modulators are heat sensitive devices and when the heat sensitive device is selected the hot mirror is automatically selected.

12. An automated multiparameter luminaire of claim 10 wherein one or more of the other light modulators are heat sensitive devices and when the heat sensitive device is selected the diffuser is automatically selected.

13. An automated multiparameter luminaire of claim 1 wherein the heat sensitive device is a glass gobo.

14. An automated multiparameter luminaire of claim 10 wherein the hot mirror engages the light beam an a non-normal (not perpendicular) to the central axis of the light beam whereby the reflected energy is not directed directly back at the light source of the light beam.

15. An automated multiparameter luminaire of claim 10 wherein one or more of the other light modulators is a glass gobo.

16. An automated multiparameter luminaire of claim 10 wherein said articulated selector is oscillated while either the hot mirror or the diffuser homogenizer is engaged in the light beam.

* * * * *